United States Patent [19]

Lanzani

[11] 4,255,942

[45] Mar. 17, 1981

[54] AUTOMATIC SELF-CONTAINED ICE CUBE MACHINE

[75] Inventor: Emanuele Lanzani, Milan, Italy

[73] Assignee: King-Seeley Thermos Co., Prospect Heights, Ill.

[21] Appl. No.: 2,718

[22] Filed: Jan. 11, 1979

[30] Foreign Application Priority Data

Feb. 2, 1978 [IT] Italy ..... 19904 A/78

[51] Int. Cl.[2] ..... F25C 1/04

[52] U.S. Cl. ..... 62/348; 62/347

[58] Field of Search ..... 62/340, 347, 348, 74; 239/468, 553

[56] References Cited

U.S. PATENT DOCUMENTS

| | | | |
|---|---|---|---|
| 3,289,430 | 12/1966 | Dedricks et al. | 62/347 X |
| 3,303,837 | 2/1967 | Rither | 126/113 |
| 3,386,258 | 6/1968 | Zygiel | 62/347 X |
| 3,407,621 | 10/1968 | Dedricks et al. | 62/347 X |
| 3,465,537 | 9/1969 | Nelson | 62/348 X |
| 3,812,686 | 5/1974 | Tester | 62/180 |
| 3,824,985 | 7/1974 | Hetherington | 126/113 |
| 3,969,909 | 7/1976 | Barto et al. | 62/340 X |
| 4,003,214 | 1/1977 | Schumacher | 62/340 |
| 4,027,499 | 6/1977 | Barto et al. | 62/340 |

*Primary Examiner*—William E. Wayner
*Assistant Examiner*—William E. Tapolcai, Jr.
*Attorney, Agent, or Firm*—Harness, Dickey & Pierce

[57] ABSTRACT

A portable ice cube making machine comprising a plurality of inverted ice forming cups disposed above a water spraying mechanism. The water source for the machine consists of a water reservoir consisting of first and second chambers, the first of which is provided with a pump for transferring water therefrom to the spray mechanism, with the first chamber being supplied with water from the second chamber which is substantially larger than the first chamber so as to contain sufficient water for several ice producing cycles and obviate the need for the machine to be connected to a conventional source of water via conventional plumbing. The spray mechanism is in the form of at least two semi-spherical enclosures to which water is supplied by the pump and is therein caused to circulate in a circular fashion to produce the desired water spray.

6 Claims, 9 Drawing Figures

AUTOMATIC SELF-CONTAINED ICE CUBE MACHINE

BACKGROUND AND SUMMARY OF THE INVENTION

The present patent for industrial invention is related to an automatic machine for the production of ice cubes, independent of any connection with the water system, made especially for household use, offices or small establishments.

Many types of automatic ice cube machines are known, made to be installed in public places, such as bars, restaurants, hotels and such, capable of a continuous ice cube production: all these machines require a continuous in- and outflow of water, their operation depending on a continuous cycle of an influx and discharge flow of water to a refrigerator; the above indicates therefore, the necessity of a connection with the general water system, and therefore the installation of a permanent kind, with resulting sensitive problems for home use, small establishments, offices, caused by the machines themselves. The machines known are moreover costly, and therefore not desirable for the above uses.

Consequently, the aim of this discovery is to furnish an ice cube machine that is completely free and independent of any water connection and that would be inexpensive, so that it could be used as a household appliance, in offices and small establishments.

The automatic machine for making ice cubes, according to the invention, has attained these aims because it furnishes a water tank able to contain a larger quantity of water than that necessary for one cycle of ice cube production, connected to the freezing units through means that can produce a continuous cycle of water between the water tank itself and these freezing units.

To be more specific, the machine invented is of the kind in which the freezing units are constituted of many small inverted cups connected to an evaporator and overhanging devices able to spray the water to be frozen into said small cups; the above-mentioned water tank is therefore connected to the spraying parts by means of a small duct connected to a pump immersed in the water tank itself, while a small discharge container collects the unfrozen water which is conveyed through a discharge duct, back to the water tank.

Another characteristic of the invention is that, in order to accelerate the cycle of production, the water tank is built in two compartments connected with each other at the bottom by a small opening, one of the parts having a capacity substantially equal to the quantity of water necessary for one or more cycles of production, the emission pump and the small discharge duct are immersed in this compartment, within which, during each cycle of production, a progressive cooling of the water takes place.

The spraying devices are furthermore built in such a way as to avoid the clogging of the spray tips through calcium deposits, possible particularly because there is no continuous renewal of water, as there is in conventional machines. Special devices are furthermore used to facilitate the easy access to various components for maintenance and cleaning especially.

These and further characteristics of the invention emerge from the following description, relating to a preferred way of illustrating the discovery—to give examples rather than set limits—in the figures of the drawings.

DESCRIPTION OF THE PREFERRED EMBODIMENTS

Figure 1:
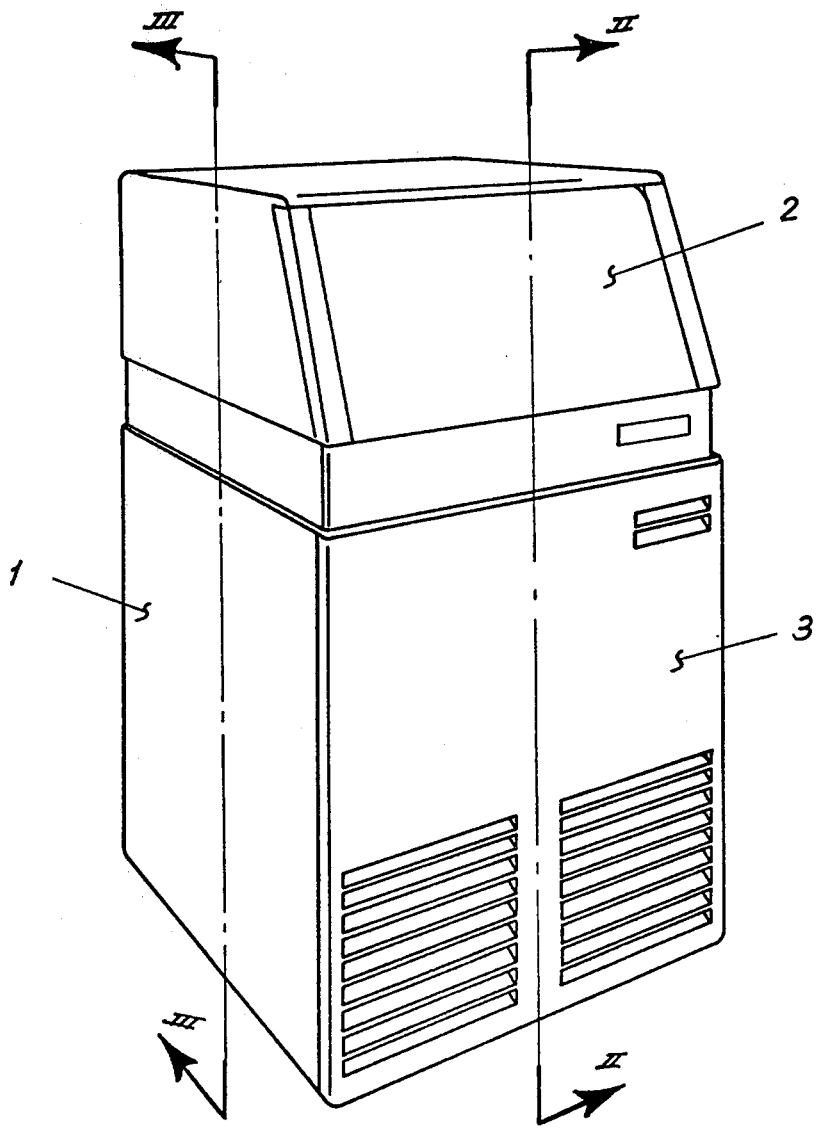
FIG. 1 illustrates a view in perspective of the entire ice making machine invented.
Figure 2:
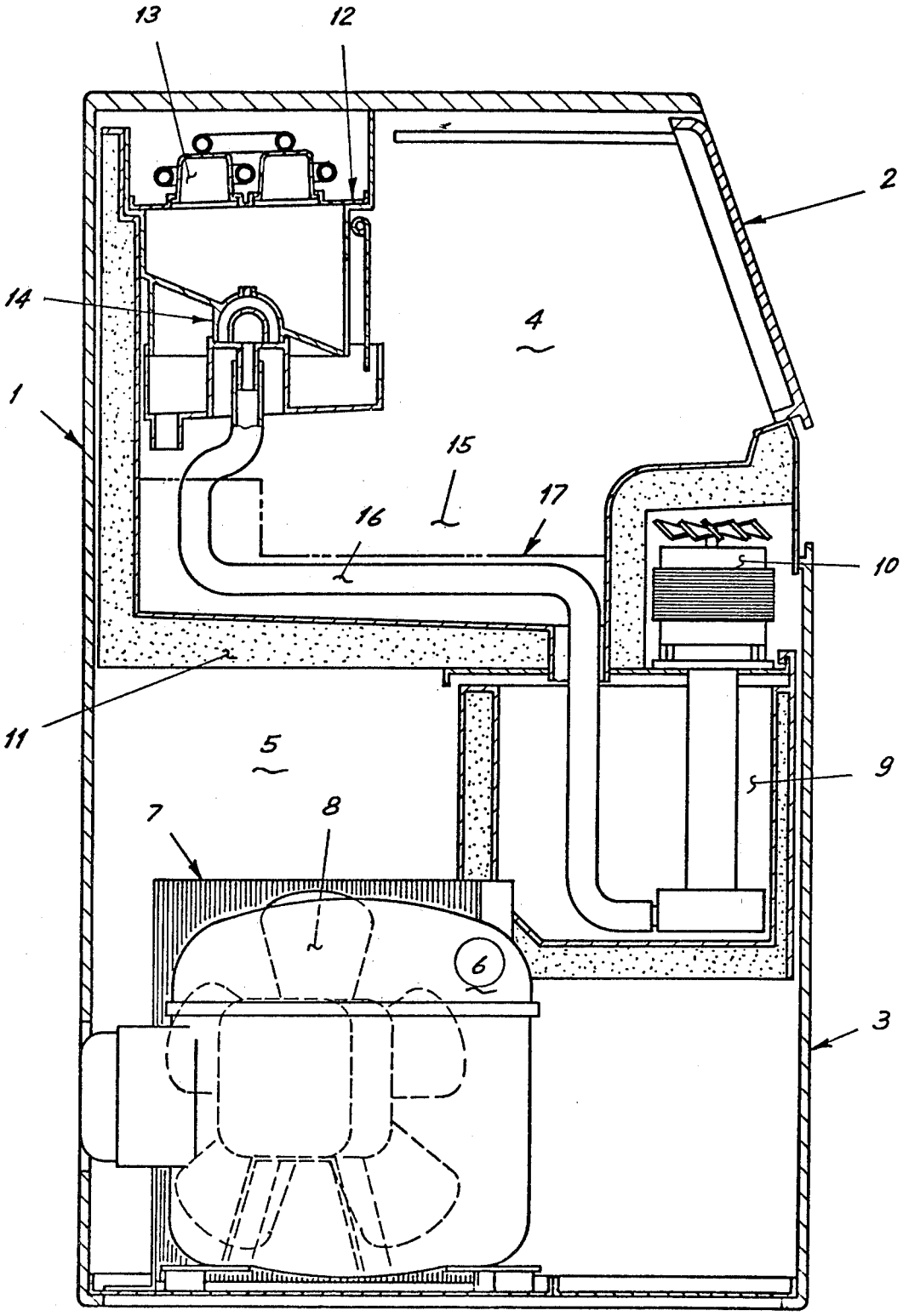
FIG. 2 illustrates a cross section according to II—II in FIG. 1.
Figure 3:
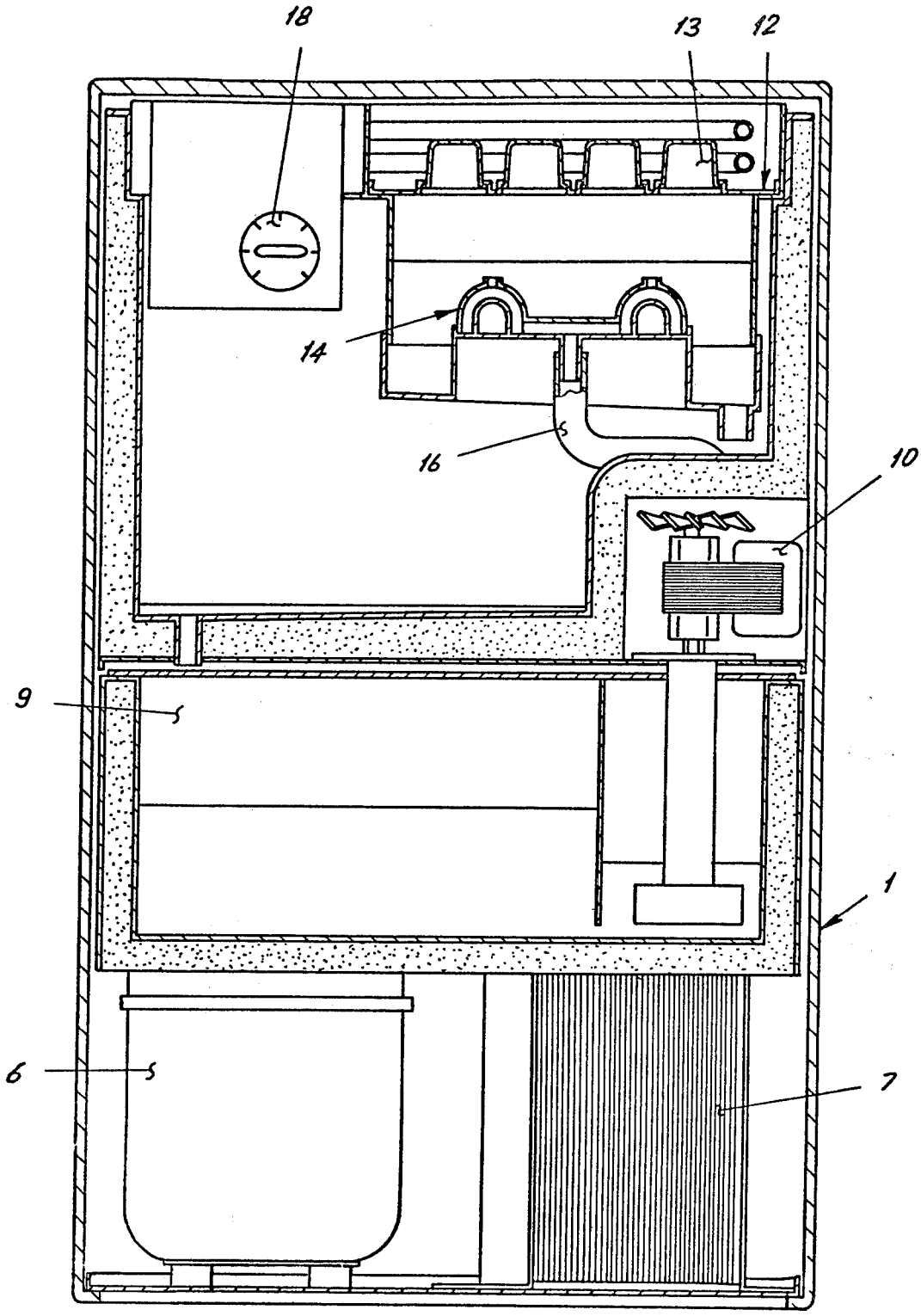
FIG. 3 illustrates a cross section according to III—III in FIG. 1.

In reference to the figures cited, the ice cube machine, according to the invention, is a compact mobile container, generically indicated at 1, having an upper small disappearing door in front 2, as well as a small lower door 3.

The interior delimited space of the movable container 1, is divided into an upper compartment 4, thermically insulated, constituting the cell for the production and gathering of the ice cubes, and into a lower compartment, called compartments because they are acessible from the outside and the front, respectively through the small doors 2 and 3.

Within the lower compartment 5 are located the compressor 6, the condensor 7 joined to the ventilator 8, in themselves conventional, and also a removable water container that will be described in detail later, placed so that it will be accessible from the outside, through the front of the appliance 1. In the lower compartment 5 is also the pump unit generically indicated by 10.

The upper compartment 4 is delimited by a box-like body 11 constructed of thermically insulating material, it contains the evaporator 12, joined to a number of small inverted cups 13, to constitute the refrigerator, the spraying unit, generically indicated by 14, and it also determines the tub 15 to receive the ice cubes; the ducts 16 and 17, respectively for intake and outflow, connect the spraying unit 14 to the water container 9, the intake duct 16 being connected to the pump unit 10, immersed in the water container itself.

Figure 5:
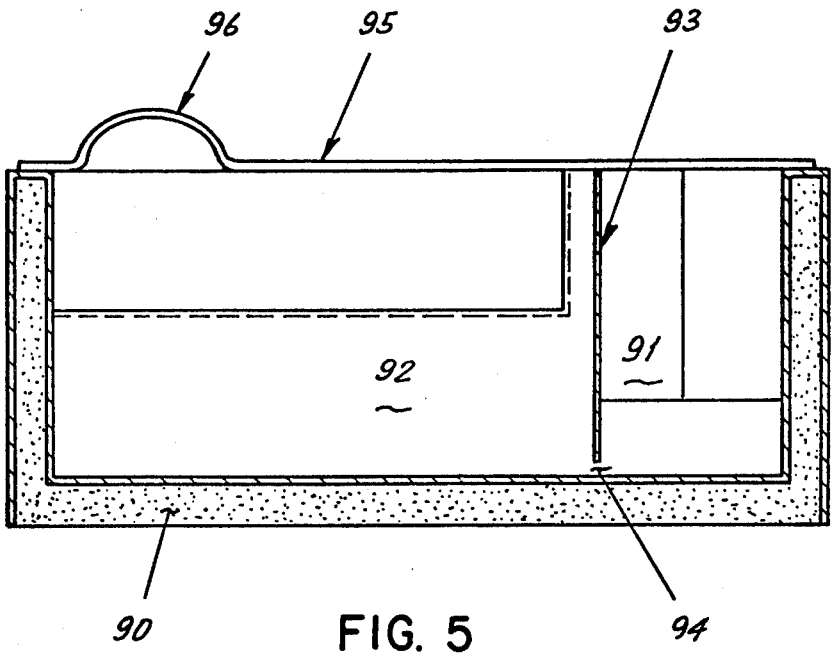
FIG. 5 illustrates a section according to V—V in FIG. 4.
Figure 4:
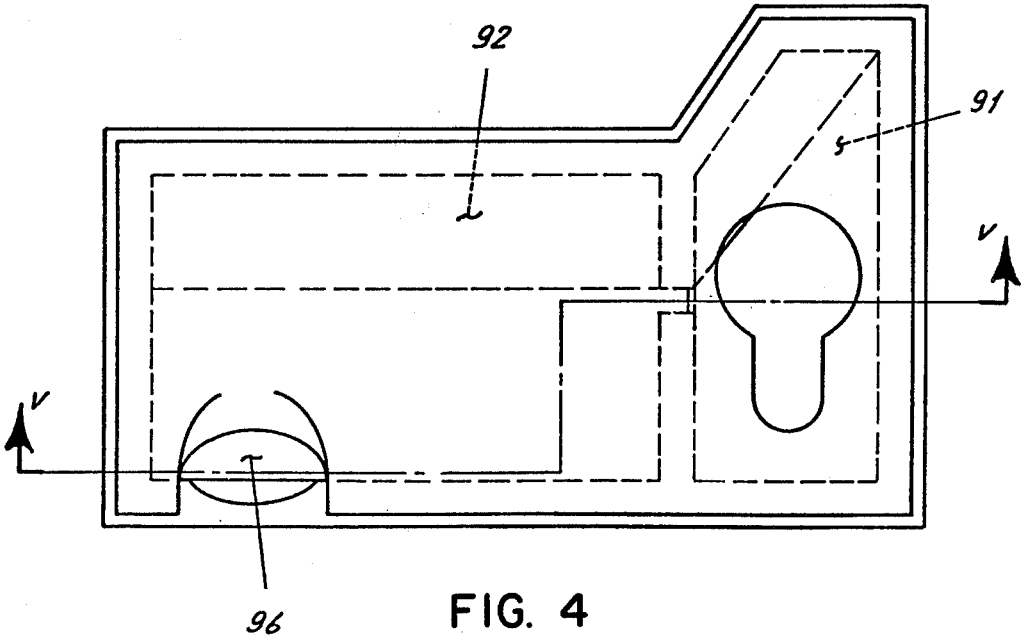
FIG. 4 illustrates a plan view of the water tank of the invention.

The water container 9, with a capacity large enough to hold a greater amount of water than that necessary for the production of one cycle of ice cubes, is illustrated in detail in FIGS. 4 and 5; this container is constructed in the form of a box 90, made of thermoinsulating material, divided in two sectors, respectively 91 and 92, by a diaphragm 93, also made of thermoinsulating materials; the sectors 91 and 92 are intercommunicating through a small hole of communication 94, located next to the hole in the water container itself, on the diaphragm 93. Sector 91 has such a capacity that it is able to receive a quantity of water greater than that necessary for a cycle of production by the machine, while sector 92 is destined to receive the rest of the water that remains.

The water container 9 also has an upper lid 95 (visible in FIG. 5) provided with a protrusion 96, permitting the filling of the container itself with water, by means of a conventional pitcher or bottle, avoiding thus the necessity of removing the water container from its place and removing only the lower door 3. On the other hand, the possibility to remove the water container 9 allows its periodical removal with great ease for cleaning purposes with running water which is advantageous.

Figure 8:
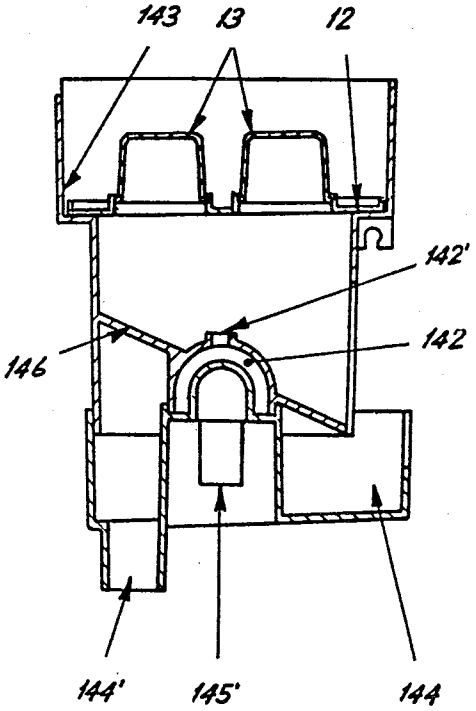
FIG. 8 illustrates the section according to VIII—VIII in FIG. 6.
Figure 6:
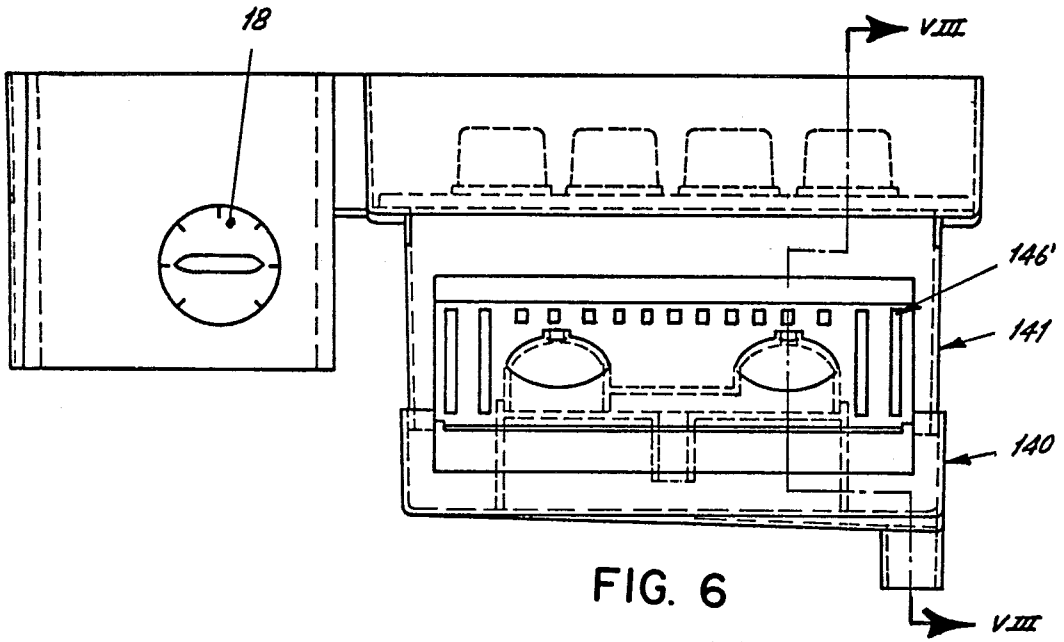
FIG. 6 illustrates in a front view the detail of the spraying and freezing unit according to the invention.
Figure 7:
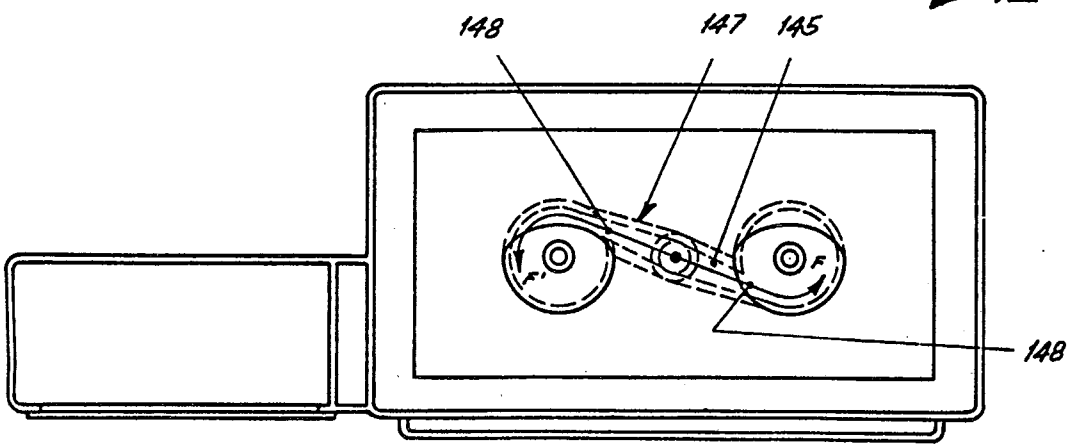
FIG. 7 illustrates the spraying unit according to the invention seen from above.

The spraying unit 14, illustrated in detail in FIGS. 6, 7 and 8, is formed by assembling a lower box of distribution and discharge 140 and of an upper element 141 carrying the spraying elements 142 and it is also provided with an upper chamber 143 to house the evaporator 12 and the small cups 13.

The box of distribution and discharge 140, made en bloc of stamped plastic, is formed in the shape of external circular discharge room 144, provided with a small orifice 144', and of an inner duct 145 of extremely reduced dimensions, provided with a small discharge orifice 145'.

The upper element 141, also made in one piece of stamped plastic material, has three vertical walls, forming at the top a step creating the aforementioned seat 143, and an inclined element 146 presenting a number of slits 146', connecting the upper space to the discharge room 144, and also the two sprayers 142 in the shape of a semi-spheric dome and provided at the top with an opening 142' with cylindrical section and considerable diameter; the surfaces delimiting the sprayers 142 define, within the tube 145 determined by the joining of the receiving and discharge box 140 with the upper element 141, two walls 147 that delimit two openings 148, the function of which will be described later.

Figure 9:
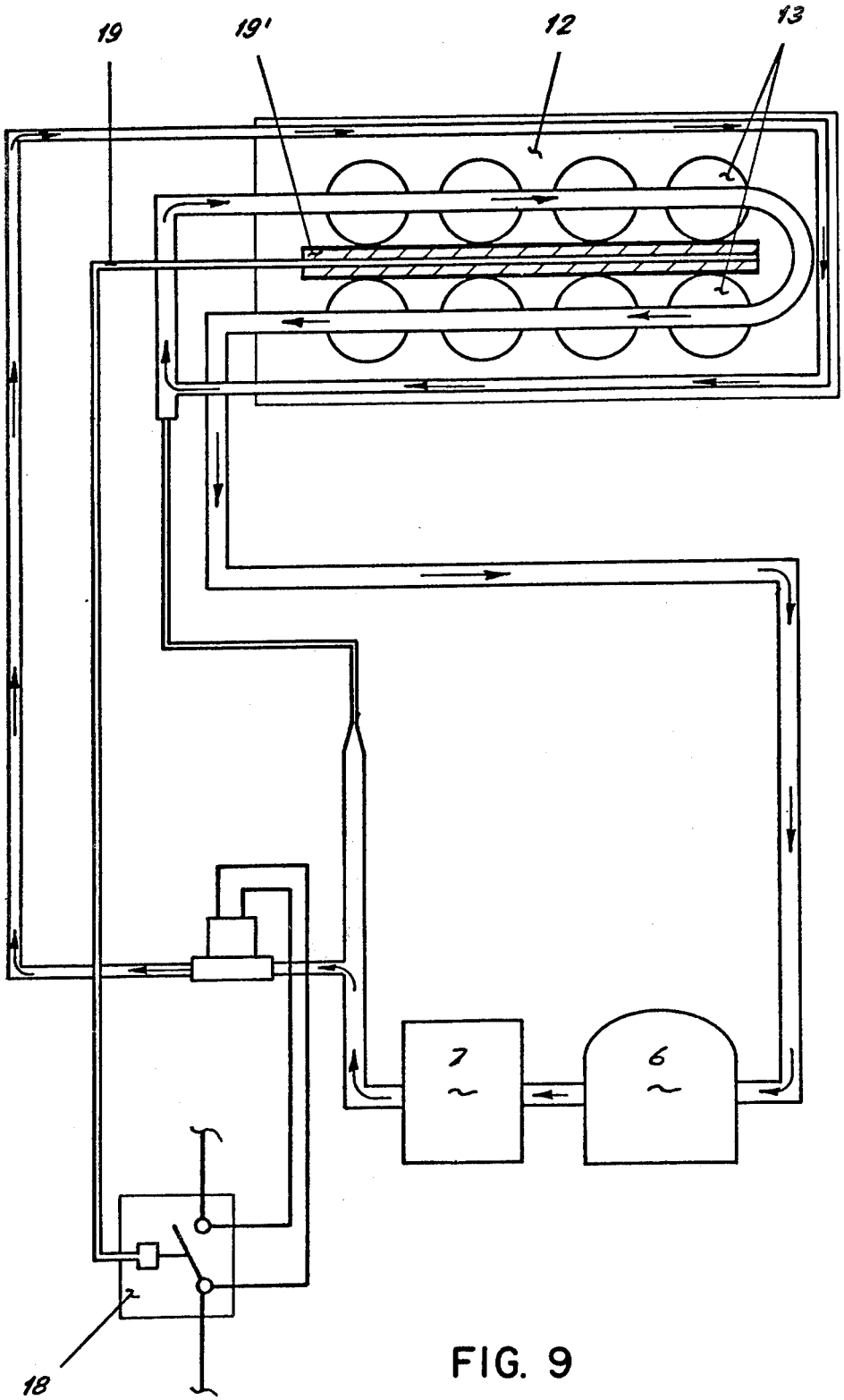
FIG. 9 illustrates in outline the regulating device of the refrigerator unit, according to the findings, in the inversion phase of the cycle.

The freezing unit, formed by joining the small copper cups 13 to the serpentine evaporator 12, is in itself of a conventional type, except that a special control is connected to it that is able to reverse the cycle of ice production, illustrated schematically in FIG. 9; a thermostat 18 is connected to a sensor 19, covered with thermically insulated material 19', set in direct contact with each one of the small copper cups 13; since it is possible to determine beforehand and empirically the temperature of the small copper cups 13 to which the complete formation of an ice cube corresponds, during a normal cycle of refrigeration, knowing the isolating power of the material 19', it is therefore possible to preset the thermostat 18 in such a way that it will control the reversal valve of the cycle 20, predisposed to determine the dropping of the formed ice cubes, in a direct manner: thus the necessity which exists in conventional techniques, to connect a timer to the thermostat, does not exist and therefore there is a reduction in cost and a better guarantee for the correct functioning of the machine.

The operation of the machine and its most important phases and characteristics are illustrated herebelow:

The machine is installed by simply plugging it into the electrical circuit, without having to use any water connection: then the user removes the lower door 3, reaches the water tank 9, fills it with water through the opening 96 with a pitcher, a bottle or any other container. The machine is therefore started with a conventional electrical switch that starts the compressor 6, the fan 8 and the feeding pump 10: the conventional cycle of refrigeration is thus started, while the pump 10, immersed in sector 91 of the water container 9, feeds the water, through the duct 16, to the distribution tube 145, thanks to the presence of the walls 147 and the tangential arrangement of the openings 148, the water penetrates into the sprayers 142 in the direction indicated by arrows F and F', and it will be sprayed toward the small cups 13 in a whirling motion, in order to achieve an even distribution and to limit the force of the spray against the walls of the cups 13 themselves. The water not immediately frozen falls therefore into the ring-shaped discharge box 144, through the slits 146', and is then carried through the small duct 17, into the same sector 91 of the water container 9 . Continuing the cycle, the progressive forming of the ice cubes is brought about, during the separation of the water contained in sector 91 of the water container, from the leftover mass of water, an acceleration of the production cycle itself is allowed, bringing about a progressive cooling off of that mass of water; however, the exchange is now made, by virtue of the principle of communicating vessels, through the connecting opening 94 between the two sectors 91 and 92 of the water container 9.

When the ice cubes are made, the thermostat 18 determines as previously illustrated, the reversal of the refrigeration cycle, in order to allow the cubes formed in the cups 13 to detach themselves, small cubes, which, sliding over the inclined surface 146, are gathered in the thermically insulated container 15. When the cubes have fallen out, the cycle begins again, and is repeated until there is no more water in the water container 9, being interrupted by a conventional hydrostat (not illustrated) eventually furnished and immersed within the water container 9.

The preceding description refers particularly to a machine with inverted cups, but it is evident how, with its original fundamental characteristics, and in particular with the self-contained water installation, thanks to the water container 9, the sphere of the present patent is not limited to a particular application, but comprises also the application to ice makers of the chute type.

I claim:

1. An automatic ice cube machine, to be used particularly in homes, offices or small establishments, having means to provide successive freezing and harvesting cycles and comprising a water tank having a first relatively small compartment having capacity equal to the quantity of water needed for at least one complete freezing cycle; and a second relatively larger supply compartment, said compartments being continuously interconnected near the bottoms thereof so that the larger compartment serves as the source of supply of water; a freezing unit; and means for delivering water from the first compartment to the freezing unit to thereby cool said delivered water and to freeze a portion thereof; and means providing for the return of the cooled but unfrozen remainder of said delivered water to the first compartment, whereby the water in the first compartment is progressively cooled during successive cycles.

2. The invention of claim 1 wherein the capacity of the first compartment is substantially equal to the quantity of water delivered from the first compartment during one freezing cycle.

3. The invention of any preceding claim in which the water delivery means comprises a pump immersed in the first compartment.

4. The invention of claim 1 in which the freezing unit comprises a series of downwardly presented cups and the water delivery means comprises a spraying means for directing water upwardly toward said cups.

5. The invention of claim 1 in which said water tank is bodily removable from the machine for cleaning purposes.

6. The invention of claim 4 wherein said machine comprises a movable housing divided into an upper thermally insulated compartment and a lower compartment, the upper compartment encloses the freezing unit, the spraying means and a gathering bin for the formed ice, and the lower compartment encloses a compressor, condenser, and the water tank.

* * * * *